US009795164B2

(12) United States Patent
Hood

(10) Patent No.: US 9,795,164 B2
(45) Date of Patent: Oct. 24, 2017

(54) SMOKING PIPE

(71) Applicant: Jeff Hood, Aspen, CO (US)

(72) Inventor: Jeff Hood, Aspen, CO (US)

( * ) Notice: Subject to any disclaimer, the term of this patent is extended or adjusted under 35 U.S.C. 154(b) by 759 days.

(21) Appl. No.: 14/327,328

(22) Filed: Jul. 9, 2014

(65) Prior Publication Data

US 2015/0289563 A1 Oct. 15, 2015

Related U.S. Application Data

(60) Provisional application No. 61/979,903, filed on Apr. 15, 2014.

(51) Int. Cl.

| | |
|---|---|
| ***A24F 1/00*** | (2006.01) |
| ***A24F 1/32*** | (2006.01) |
| ***A24F 5/00*** | (2006.01) |

(52) U.S. Cl.
CPC ..... *A24F 1/32* (2013.01); *A24F 1/00* (2013.01); *A24F 5/00* (2013.01)

(58) Field of Classification Search
CPC ..... A24F 1/32; A24F 5/00; A24F 1/00
See application file for complete search history.

(56) References Cited

U.S. PATENT DOCUMENTS

| | | | | |
|---|---|---|---|---|
| 4,214,658 A * | 7/1980 | Crow | A24F 23/04 206/236 |
| 6,148,826 A * | 11/2000 | Lancaster | A24F 1/00 131/191 |
| 7,415,982 B1 * | 8/2008 | Sheridan | A24F 1/28 131/191 |
| 7,845,358 B2 * | 12/2010 | Danforth | A24F 1/28 128/202.21 |
| 8,534,295 B2 * | 9/2013 | Gonsalves | A24D 1/14 131/191 |
| 8,967,153 B2 * | 3/2015 | Hoang | A24F 1/28 131/191 |
| 2008/0230077 A1 * | 9/2008 | Martilik | A24F 13/00 131/202 |

* cited by examiner

*Primary Examiner* — Michael H Wilson
*Assistant Examiner* — Dionne Walls Mayes
(74) *Attorney, Agent, or Firm* — Clifford H. Kraft

(57) ABSTRACT

A smoking pipe with a jacket containing an inner glass tube. The glass tube has a hole in its wall that aligns with a hole in the jacket. The pipe has a bowl holder that holds a glass bowl with a stem that extends proximate to the hole in the glass tube. The joint between the bowl stem and an insert in the bowl holder can form a frosted glass fitting. End-caps with threaded inserts can match glass threads on the ends of the glass tube holding the glass tube in the jacket. A decorated metal bowl holder can be mounted on the jacket and decorated with gems, glass and the like. The pipe can be manufactured using different types of premium woods for the jacket for design and beauty. The use of an inner glass tube that contains the smoke eliminates contamination and cools the smoke for inhalation.

12 Claims, 5 Drawing Sheets

SMOKING PIPE

This application is related to, and claims priority to, U.S. Provisional Patent Application No. 61/979,903 filed Apr. 15, 2014. Application 61/979,903 is hereby incorporated by reference.

BACKGROUND

Field of the Invention

The present invention relates to smoking pipes and more particularly to a long pipe for the consumption of smokable products.

Description of the Prior Art

The use of pipes for the consumption of smoked organic products is known in the art. There are numerous types of pipes that have been used over the years to smoke tobacco and other organic products. The Native American peace pipe has been in use for over 200 years. In addition, there are numerous types of pipes used to smoke tobacco, cannabis and other organic products. These include water pipes, straight pipes, steamroller pipes, briar pipes and numerous specialty pipes. Many pipes for smoking cannabis are small and made of glass, since glass avoids any interaction of the heated smoke with wood or other material. Glass pipes however are fragile and have the tendency to get hot. The common element of various cannabis pipes is a narrow screened receptacle called a stem which may be a long flexible tube or a rigid tube. The smoking material is placed in the receptacle and lit with a heat source while air is drawn through the bowl and stem to the user (See. Wikipedia under Cannabis Smoking). However, the typical glass pipe is fragile and difficult to clean, and it usually has only one fixed bowl of a various sizes and shapes.

With many states now allowing the medical use of cannabis, and at least two states at the present time (Colorado and Washington) allowing the recreational use of cannabis by anyone of legal age, there is a renewed interest in pipes that are designed specifically for cannabis. Of course, any of these various pipes can also be used with tobacco or other smoked substances. It would be advantageous to have a long pipe for smoking that overcomes the disadvantages of the prior art pipes, in particular a pipe that is easy to clean, protected from breakage and can be supplied with interchangeable bowls.

SUMMARY OF THE INVENTION

The present invention relates to an elongated smoking pipe with a wood jacket containing an inner glass tube (the jacket can also be made from other materials). The glass tube has a hole in its surface wall that aligns with a hole in the surface of the wood jacket. The pipe has a bowl holder that accepts a glass bowl with a stem that mates into the hole in the glass tube. End-caps with threaded inserts can match threads on the ends of the glass tube holding the glass tube in the wood jacket. The glass tube can be made without threads and fixed in position by end caps having a wedge or compression fitting, pressure fitting, slip joint, pinch joint or other affixing means. A decorative metal bowl holder can be mounted on the wood jacket and decorated with gems and the like. The pipe can be manufactured using many different types of premium woods for design and beauty. The use of an inner glass tube that contains the smoke eliminates any contamination problems from the wood and the long length from the bowl to the mouth piece helps cool the smoke making it less harsh and more pleasant to inhale.

DESCRIPTION OF THE FIGURES

Attention is now directed to several figures that illustrate features of the present invention.

Several drawings and illustrations have been presented to aid in understanding the present invention. The scope of the present invention is not limited to what is shown in the figures.

DESCRIPTION OF THE PREFERRED EMBODIMENT

The present invention relates to a long pipe that can be used for the smoking of legal cannabis, tobacco or other smoked products. A preferred embodiment includes a glass pipe, interchangeable bowls, a wooden tube for holding the glass pipe, interchangeable mouthpieces, decorative ends and a bowl holder. The glass bowl stem and a glass insert in the bowl holder can be fitted together with frosted laboratory joints that form a gas and moisture seal, seamless connections between the two pieces of glass that are easy to separate.

Figure 1:
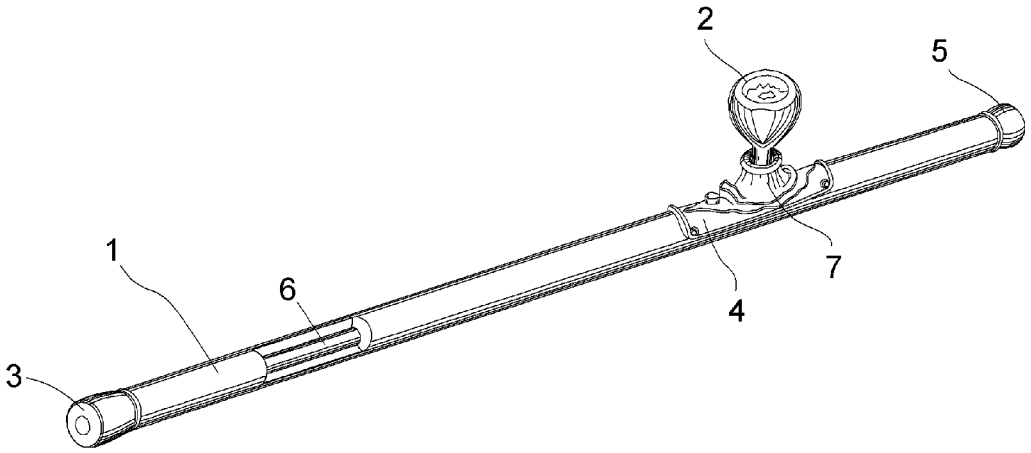
FIG. 1 shows a perspective view of an embodiment of the present invention.

Turning to FIG. 1, it can be seen that the present invention includes an elongated glass tube 6 suspended in a hollow wooden tube or jacket 1. The length of the wooden tube or jacket 1 is such that the glass tube 6 just fits into it end-to-end. A surface hole 8 (FIG. 2) is located in the glass tube 6 at the position of the bowl approximately two-thirds to three-fourths the distance down the tube from the mouthpiece region 3. A glass bowl 2 with a laboratory frosted fitting on its upper stem can be inserted into the bowl holder 7, through the wood jacket and fit into the hole in the glass tube. A matching hole is located in the wooden tube or jacket 1 for the bowl stem to pass through. A metal or other decorative bowl holder 4 and 7 can be mounted on the wooden tube 1 atop the hole. A glass insert 9*a* (FIG. 2) in the bowl holder 7 can also be frosted and can mate with the bowl stem to form a vapor seal. The bowl holder 7 can optionally contain decorations, gemstones, engravings or the like to give the pipe an individual character.

Figure 2:
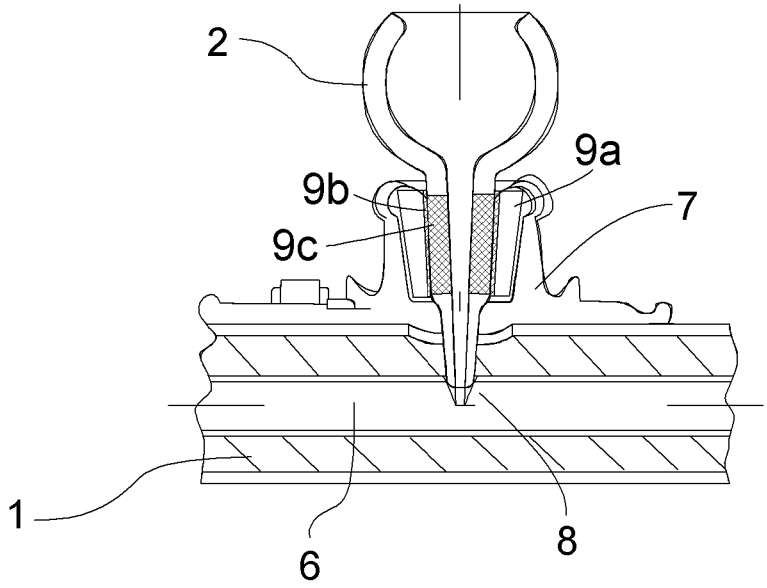
FIG. 2 shows a cross section of a bowl mounted in the pipe tube.

FIG. 2 shows a cross section of the bowl 2 inserted into the elongated glass tube 6 into a hole 8. The elongated glass tube 6 fits into the hollow tunnel of the wood pipe 1 and can be supported on each end by a threaded fitting inside the end-caps 3 and 5. FIG. 2 also shows a glass insert 9*a* that fits into the bowl holder 7. The inside surface 9*b* of the glass insert 9*a* can be frosted to match frosting 9*c* on the bowl stem. The end of the bowl stem can fit either loosely or tightly into the hole or slot 8 in the glass tube 6.

Figure 3A:
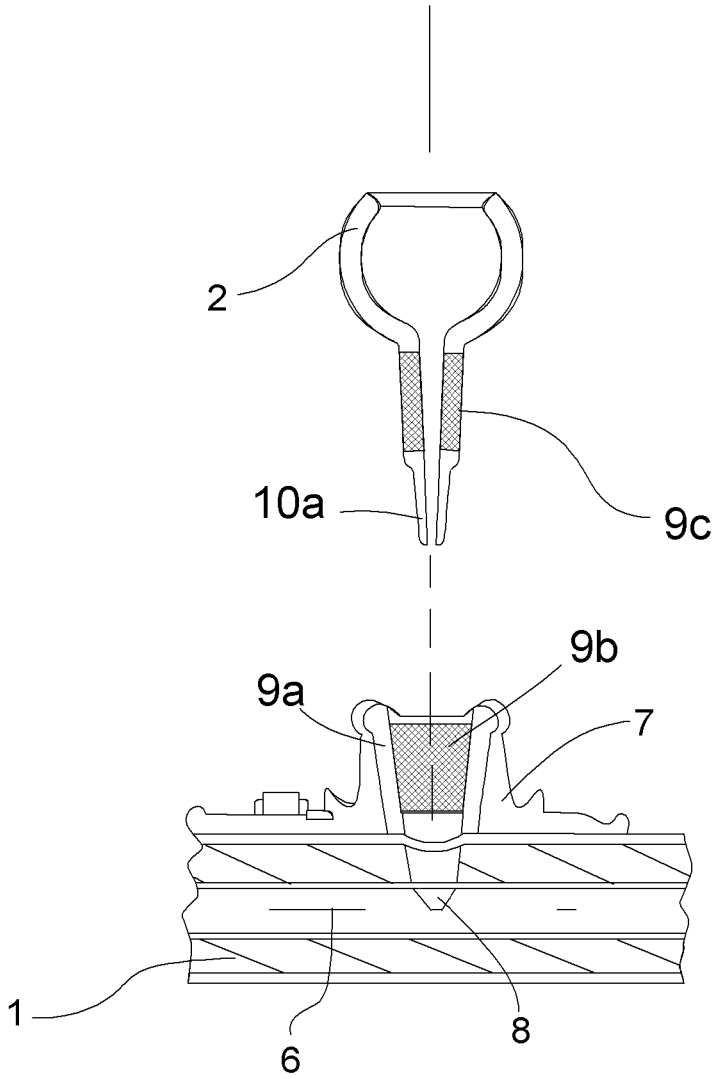
FIG. 3A shows the embodiment of FIG. 2 with the bowl removed.
Figure 3B:
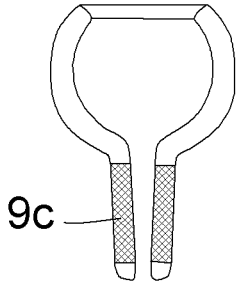
FIG. 3B shows an alternate embodiment of the bowl with no drip tip.

FIG. 3A shows the embodiment of FIG. 2 with the bowl 2 removed. A glass insert 9*a* can be seen positioned in the bowl holder 7. This can be press fit or glued into the bowl holder 7. The inside surface 9*b* of the glass insert 9*a* can be frosted to match frosting 9*a* on the bowl stem. The bowl 2 can have a frosted region 9*c* on its stem that mates with the frosted region 9*b* in the glass insert 9*a*. The frosted connections can make a vapor-tight seal but provide for easy removal. The bowl stem in FIG. 3A has an optional drip tip. FIG. 3*b* shows the bowl 2 without a drip tip 10*a*.

FIG. 3B shows the bowl with an optional blunt tip that extends into the wood pipe jacket, but does not extend into the glass tube 6.

Figure 4:
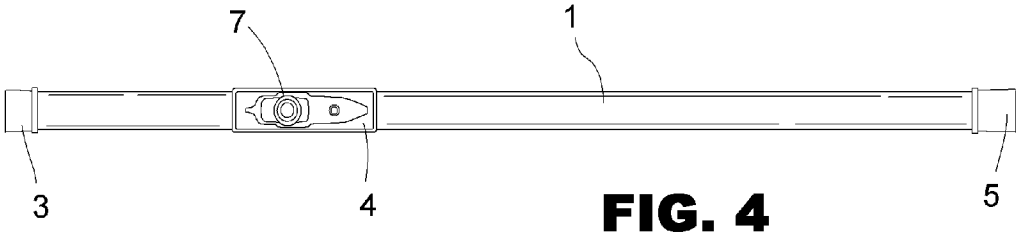
FIGS. 4-5 show top and side views of an embodiment of the pipe.
Figure 5:
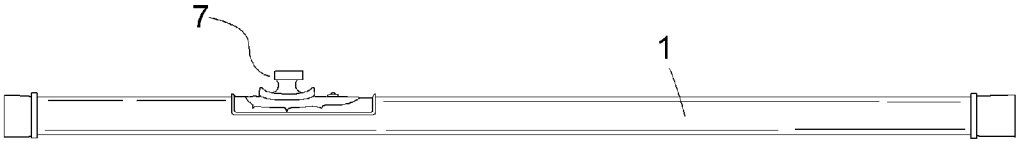

FIGS. 4-5 show a top and side view of an embodiment of the pipe. Threads on a plastic insert in either the end-cap 3 or the mouthpiece 5 match glass threads 9 (FIG. 7) that are manufactured into the glass tube. Suspending the glass tube in this manner acts as a shock-absorber to protect the glass tube from breaking, for example, if the pipe is dropped.

Figure 6B:
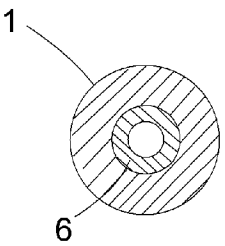
FIG. 6B shows a cross-section of the pipe with no support nub.
Figure 6A:
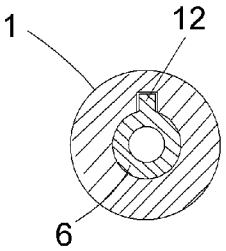
FIG. 6A shows a cross-section of the pipe where the glass tube has a single nub for rotational support.

FIG. 6A shows a cross-section of the wood 1 and glass 6 tubes with an optional single nub 12 that can provide rotational stability. FIG. 6B shows the same cross-section with no nub. Two similar opposing nubs may optionally also be used for even greater stability. When nubs are used, one or two corresponding receiving slots should be cut on the inside of the wood tube 1.

Figure 7A:
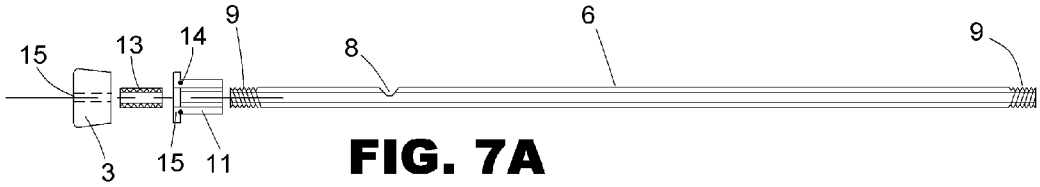
FIG. 7A shows the inner glass tube along with the end-piece hardware.
Figure 7B:
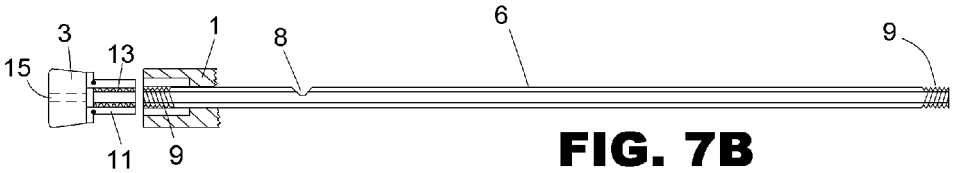
FIG. 7B shows the end-piece hardware from FIG. 7A assembled.

FIG. 7A shows the glass tube 6. Each end has glass threads 9 that mate with threads in a plastic (or any other semi rigid material) insert 13. A T-nut or plug 11 is adapted to fit into the end of the wood jacket 1 (FIG. 1). This T-nut 11 receives the treaded plastic insert 13. The T-nut 11 can be made of brass, stainless steel, aluminum or other material, and can have a slot or groove 14 on the end piece-facing side that receives an O-ring 15. The 0-ring made of rubber or soft material such as silicone secures the end pieces and provides and air tight seal to the pipe. Finally, the T-nut 11 can be pressed, glued or otherwise inserted into a space in the actual end-cap 3 or mouthpiece 5. This leads to a system where the glass tube 6 is easily removable for cleaning. Optionally the glass tube 6 can be made without threaded ends. In that instance the insert 13 is made without mating threads but is smooth to allow the T-nut 11 to be pushed or twisted onto the glass ends to hold the glass tube and end caps in place. FIG. 7B shows the end piece hardware and mouthpiece of FIG. 7A assembled.

Cleaning is typically accomplished by removing and soaking the glass tube and glass bowl in cleaning solvent with no worry about hurting the valuable wood pipe and other components. The glass threads 9 on each end of the glass tube secure the glass tube in place and allow a simple method for assembly and disassembly of the end-pieces.

The use of a glass tube fitted into a wooden tube gives the illusion of smoking from an attractive, decorative wood pipe with a glass bowl without any of the health concerns of smoking directly from a wood or metal pipe. As previously stated, it is well-known that smoking directly from wood or metal may pose a health risk especially since the hot smoke has a tendency to remove and mix with potentially dangerous products emitted from the wood or metal. The removable glass bowl 2 can be interchanged with a variety of other similar glass bowls, each with a distinctive bowl style, size, color or shape. The wood is mainly decorative, but also functions as stated, to protect the glass. The use of wood allows the choice of beautiful natural woods set with stones, gems, glass, beads or the like, and can embossed or engraved with the owners name, other words or images. Also, all the external parts are interchangeable to allow for personal customization of the pipe (or different pipes). The fact that the wood is protective allows the pipe to be safely stored or passed to different people. The use of frosted laboratory glass fittings allows a perfect, but easily disconnectable, seal for the bowl. The pipe being long allows for cooling of the smoke before inhaling.

Embodiments of the invention can have the following optional features and/or dimensions. Each of these features or dimensions is given as an example only; any combination of features or dimensions is within the scope of the present invention. The pipe outer tube or jacket 1 can be wood, glass, ceramic or any other rigid material. The inner tube 6 can be made from standard 8 mm (or other size) laboratory glass tubing. Each end of the pipe can have an optional trim ring adjacent to the end cap 3 or the mouthpiece 5. The end piece 3 and mouthpiece 5 can be stone, bone, imitation stone, plastic, ivory, glass or any other rigid material. The bowl holder can have an optional saddle 4 as shown in FIG. 1 which can be pewter, brass, silver or other metal or rigid material. The frosted joints on the bowl stem and bowl holder glass insert can be standard 14/20 (or other) ground laboratory joints. The bowl holder 7 can optionally be used without a glass insert. The bowl stem can be made with a drip tip that extends into the hole 8 in the glass tube 6 as shown in FIG. 3A or without the drip tip as shown in FIG. 3B. Typical dimensions (given for example only) are as follows: diameter of the wood tube or jacket—approximately 24 mm, length—around 542 mm, tunnel in the tube center—approximately 11.5 mm that runs the length of the tube. An optional larger hole can be bored into the wood tube at each end of the outer jacket having a dimension of approximately 14.75 mm that penetrates approximately 12 mm to hold the T-nut 11. As stated above, dimensions have been given that represent a usable pipe; however, they are given for example only. Any sizes or dimensions are within the scope of the present invention.

Several descriptions and illustrations have been provided to aid in understanding the features of the present invention. One with skill in the art will realize that numerous changes and variations may be made without departing from the spirit of the invention. Each of these changes and variations is within the scope of the present invention.

I claim:

1. A smoking pipe comprising:

an elongated glass tube with glass threads on both a distal and proximal end, said glass threads adapted to mate with a pair of removable end-pieces or inserts in said end-pieces; and wherein said elongated glass tube includes a surface hole located nearer the distal end than the proximal end, the surface hole penetrating into the glass tube;

a cylindrical outer tube having a length similar to said elongated glass tube having a hole in it's cylindrical surface near its distal end positioned to align with the hole in the elongated glass tube, the outer tube adapted to receive the elongated glass tube;

at least one glass bowl having a glass stem adapted to be inserted into the hole in the outer tube so that an end of the glass stem is proximate the hole in the glass tube;

a bowl holder adapted to be mounted on said outer tube over the hole in the outer tube, the bowl holder configured to hold the glass bowl, the bowl holder receiving a frosted glass insert that mates and forms a vapor seal with a frosted region on said glass stem.

2. The smoking pipe of claim 1 wherein said elongated glass tube has an outer diameter of approximately 10 mm.

3. The smoking pipe of claim 1 wherein said bowl holder is metal.

4. The smoking pipe of claim 1 wherein said bowl holder is decorated with stones, gems or glass.

5. The smoking pipe of claim 1 wherein said outer tube is decorated with stones, gems or glass, or engraving.

6. The smoking pipe of claim 1 wherein the end-caps are bone, plastic, stone, ivory or glass.

7. The smoking pipe of claim 1 wherein said bowl holder is pewter.

8. The smoking pipe of claim 1 further comprising at least one glass nub on at least one end of said elongated glass tube configured to slide into a matching groove in said wooden tube.

9. The smoking pipe of claim 8 wherein there are two glass nubs on opposing sides of said elongated glass tube.

10. The smoking pipe of claim 1 wherein the end-piece includes a T-nut that receives a plastic or flexible material insert.

11. The smoking pipe of claim 10 wherein the T-nut has a grove for receiving a flexible O-ring.

12. The smoking pipe of claim 1 wherein said outer tube is wood.

* * * * *